US006897745B2

(12) United States Patent
Aiga et al.

(10) Patent No.: US 6,897,745 B2
(45) Date of Patent: May 24, 2005

(54) RESONATOR AND FILTER

(75) Inventors: Fumihiko Aiga, Yokohama (JP); Yoshiaki Terashima, Yokosuka (JP); Mutsuki Yamazaki, Yokohama (JP); Hiroyuki Fuke, Kawasaki (JP); Hiroyuki Kayano, Fujisawa (JP); Tatsunori Hashimoto, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/456,905

(22) Filed: Jun. 9, 2003

(65) Prior Publication Data

US 2004/0056738 A1 Mar. 25, 2004

(30) Foreign Application Priority Data

Sep. 20, 2002 (JP) ..... 2002-275563

(51) Int. Cl.[7] ..... H01P 1/20
(52) U.S. Cl. ..... 333/204; 333/206
(58) Field of Search ..... 333/202, 204, 333/206, 219, 238, 222, 246, 26

(56) References Cited

U.S. PATENT DOCUMENTS 6,021,337 A * 2/2000 Remillard et al. ..... 505/210
6,737,943 B2 * 5/2004 Takubo et al. ..... 333/206
6,759,930 B2 * 7/2004 Kayano et al. ..... 333/99 S

FOREIGN PATENT DOCUMENTS

JP 5-299914 11/1993
WO WO 02/101872 A1 12/2002

OTHER PUBLICATIONS

G. Tsuzuki et al., "Superconducting Filter for IMT–2000 Band", IEEE Transactions on Microwave Theory and Techniques, vol. 48, No. 12, pp. 2519–2525, (Dec. 2000).

J.S. Hong et al., "On the Performance of HTS Microstrip Quasi–Elliptic Function Filters for Mobile Communications Application", IEEE Transactions on Microwave Theory and Techniques, vol. 48, No. 7, pp. 1240–1246, (Jul. 2000).

J.S. Hong et al., "Cross–Coupled Microstrip Hairpin–Resonator Filters", IEEE Transactions on Microwave Theory and Techniquest, vol. 46, No. 1, pp. 118–122, (Jan. 1998).

K. Takahashi et al., "Miniaturized Hair–Pin Resonator Filters and Their Applications to Receiver Front–End Mics", IEEE MTT–S Digest, pp. 667–670, (1989).

J.S. Hong et al., "Microstrip Slow–Wave Open–Loop Resonator Filters", IEEE MTT–S Digest, pp. 713–716, (1997).

J.S. Hong et al., "Canonical Microstrip Filter Using Square Open–Loop Resonators", Electronics Letters, vol. 31, No. 23, pp. 2020–2022, (Nov. 1995).

J.S. Hong et al., "Compact Microwave Elliptic Function Filter Using Novel Microstrip Meander Open–Loop Resonators", Electronics Letters, vol. 32, No. 6, pp. 563–564, (Mar. 1996).

* cited by examiner

*Primary Examiner*—Peguy Jeanpierre
*Assistant Examiner*—Joseph Lauture
(74) *Attorney, Agent, or Firm*—Finnegan, Henderson, Farabow, Garrett & Dunner, L.L.P.

(57) ABSTRACT

There is disclosed a half-wavelength (λ/2) resonator which is constituted of a micro strip line or a strip line and in which line pattern portions are disposed symmetrically with respect to a reference line, connected to each other to form an L shape, and formed in an open loop shape so as to have open ends. For one pair of line pattern portions having the open ends, base portions connected to adjacent line pattern portions are disposed in the vicinity of the reference line, and the open ends are extended in opposite directions so that the ends are disposed apart from the reference line.

10 Claims, 6 Drawing Sheets

RESONATOR AND FILTER

CROSS-REFERENCE TO RELATED APPLICATIONS

This application is based upon and claims the benefit of priority from the prior Japanese Patent Application No. 2002-275563, filed Sep. 20, 2002, the entire contents of which are incorporated herein by reference.

BACKGROUND OF THE INVENTION

1. Field of the Invention

The present invention relates to a resonator for use in electronic apparatuses such as a communication apparatus, particularly to a resonator filter which passes only a desired band.

2. Description of the Related Art

A communication apparatus, which performs information communication by radio or wire, is constituted of various types of high-frequency component such as an amplifier, mixer, and filter. Such components include many high-frequency members having resonance characteristics. For example, a band-pass filter is constituted of a plurality of arranged resonance elements, and has a function of passing only a signal in a specific frequency band.

The band-pass filter for use in a communication system is required to have a skirt characteristic such that interference is not caused between adjacent frequency bands. Here, the skirt characteristic indicates the degree of attenuation extending to a blocking band from a pass band end. If a band-pass filter having a steep skirt characteristic is used in a radio apparatus, a communication frequency is effectively used in a communication system.

A method of realizing a filter having a steep skirt characteristic is reported, for example, in IEEE Transactions on Microwave Theory and Techniques, Vol. No. 48 (2000), pages 2519. This document discloses a method of using a large number of resonance elements constituting the filter as in a 32-pole filter. However, since a large number of resonance elements are used, this method has the drawback of enlarging a radio apparatus. Moreover, even in the filter in which a superconductor is used as a conductor constituting the resonance element to minimize conductor loss, the conductor loss becomes remarkable with the use of a large number of resonance elements. There is a problem that insertion loss increases.

As a method of realizing a filter having the steep skirt characteristic without using a large number of resonance elements, for example, there is a method of using a pseudo-elliptic function type filter, as reported in IEEE Transactions on Microwave Theory and Techniques, Vol. No. 48 (2000), pages 1240. When an attenuation pole is disposed in the vicinity of the pass band, this filter can realize a steep skirt characteristic with a small number of resonators. At this time, the filter including the attenuation pole is realized by using coupling between adjacent resonance elements and coupling between nonadjacent resonance elements which has a reverse phase. To realize the coupling of the reverse phase, one needs to be electric coupling and the other needs to be magnetic coupling. In a distributed element circuit, the electric coupling is obtained by coupling resonance element ends which are maximum voltage portions to each other. On the other hand, the magnetic coupling is obtained by coupling resonance element middle portions, which are maximum current portions to one another. That is, to realize the pseudo-elliptic function type filter in the distributed element circuit, both the electric coupling and the magnetic coupling need to be realized.

As a simplest example of a distributed element type half-wave length resonance element in which both electric coupling and magnetic coupling can be realized, there is a hair pin type resonance element reported in IEEE Transactions on Microwave Theory and Techniques, Vol. No. 46 (1998), page 118. An example of miniaturization in which the tip end of a hair pin is folded back to impart a capacitive property is reported in IEEE Microwave Theory and Techniques Symposium Digest, (1989), page 667. Moreover, an example of miniaturization in which the tip end of the hair pin is set to have a low impedance and the capacitive property is imparted is reported in Jpn. Pat. Appln. KOKAI Publication No. 5-299914 and IEEE Microwave Theory and Techniques Symposium Digest, (1997), page 713. An open loop type resonance element which is miniaturized by folding the tip end of the hair pin to impart the capacitive property is described in Electronics Letters, Vol. No. 31 (1995) page 2020. A meander open loop type resonance element which is constituted of a meander line and further miniaturized is disclosed in Electronics Letters, Vol. No. 32 (1996) page 563.

On the other hand, a substrate material forming the filter has a dispersion of thickness in the substrate plane or a dispersion of permittivity by crystal defects. Therefore, there has been a demand for a circuit which has a small dispersion of the filter characteristic by the dispersions of material characteristics. However, in reality, the filter characteristic sometimes deviates from a desired value by the dispersion of the material characteristic. In this case, there is a method of finely adjusting the length of each resonance element constituting the filter.

As described above, for the related-art small resonance element whose element tip ends are disposed opposite to each other, when the element tip ends are removed in order to finely adjust the length, the charged capacity is rapidly changed. This is because the element tip ends are disposed opposite to each other. Moreover, the resonance frequency rapidly changes. Therefore, there is a problem that fine adjustment is difficult.

BRIEF SUMMARY OF THE INVENTION

According to an aspect of the present invention, there is provided a resonator comprising:

strip lines which are disposed on opposite sides of a reference line and which are formed in an open loop shape having openings on the reference line, wherein open ends extended from the openings are disposed apart from the reference line.

Moreover, according to an another aspect of the present invention, there is provided a filter comprising:

a first resonator which includes strip lines disposed on opposite sides of a reference line and formed in an open loop shape having openings on the reference line and in which open ends extended from the openings are disposed apart from the reference line; and a second resonator which includes strip lines formed in the open loop shape.

DETAILED DESCRIPTION OF THE INVENTION

A resonance element according to embodiments of the present invention will be described hereinafter with reference to the drawings.

(First Embodiment)

Figure 1:
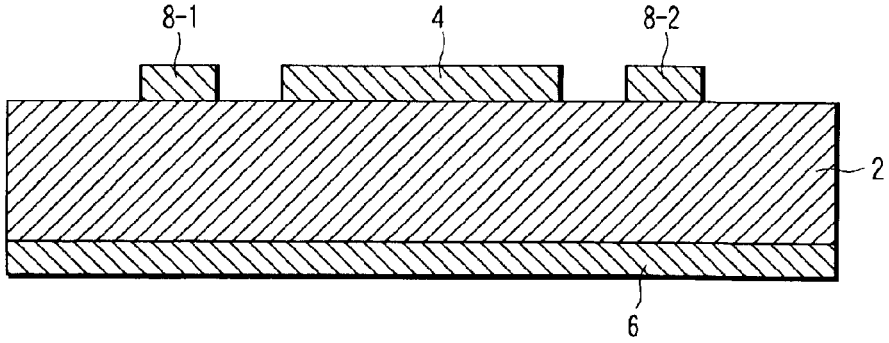
FIG. 1 is a sectional view schematically showing a resonator according to a first embodiment of the present invention.

FIG. 1 is a sectional view schematically showing a resonator according to a first embodiment of the present invention.

The resonator shown in FIG. 1 is a super-conductive micro strip line resonator. In an upper surface of a substrate 2, a pattern 4 of the resonator is disposed, and excitation lines 8-1, 8-2 are disposed on opposite sides of the pattern 4 of the resonator. In a lower surface of the substrate 2, a YBCO thin film 6 of a superconductor is formed. This substrate 2 is formed of MgO which has a thickness, for example, of 0.43 mm and whose dielectric constant is, for example, about 10. The pattern 4 of the resonator is disposed in a region between the excitation lines 8-1, 8-2.

Here, the micro strip line resonator will be described as an example, but this also applies to a resonator in which a strip line is used.

Figure 2:
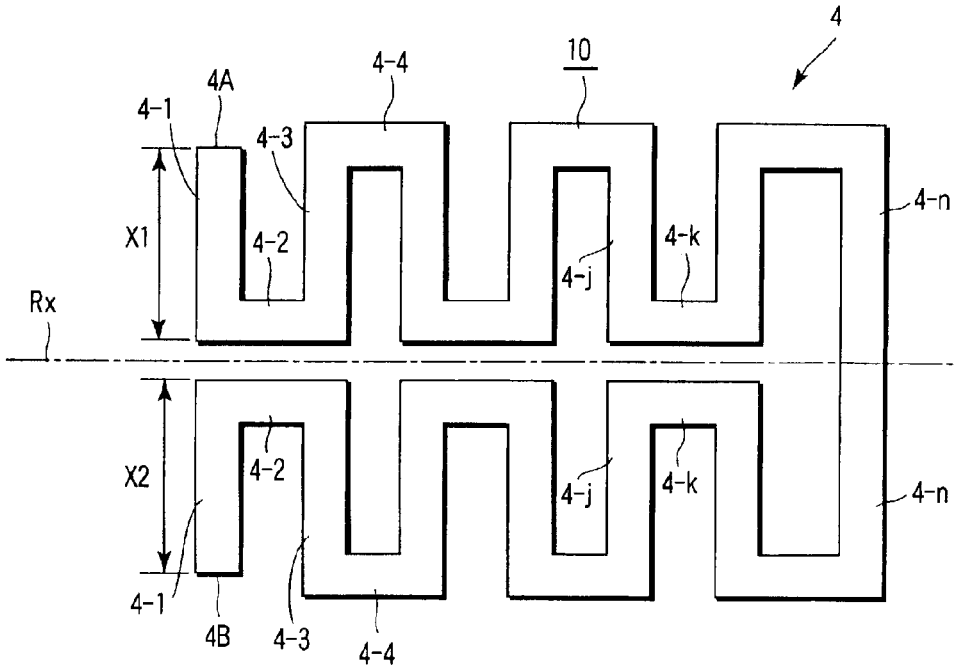
FIG. 2 is a plan view showing a pattern of the resonator shown in FIG. 1.

FIG. 2 is a plan view showing the pattern 4 of the super-conductive micro strip line resonator formed on a upper surface of the substrate 2, shown in FIG. 1. This resonator pattern 4 is substantially symmetrical with respect to a certain reference line Rx. An electrical conductive pattern 10 is formed in an open loop shape so as to have open ends 4A, 4B, and bent and extended along the reference line Rx. That is, straight line pattern portions 4-1 to 4-n corresponding to respective segments of the electrical conductive pattern 10 are arranged substantially symmetrically with respect to the reference line Rx. These line pattern portions 4-1 to 4-n are combined, connected, and disposed successively in a chain form so as to form L shapes. Here, line pattern portions 4-1 to 4-n forming the respective pairs are symmetrical with respect to the reference line Rx, and therefore have the same pattern length.

In the resonance pattern 4 shown in FIG. 2, on the open-end side of the open loop shape, the line pattern portions 4-1, 4-1 are extended substantially at right angles to the reference line Rx, apart from the reference line Rx, and in directions opposite to each other so as to have the open ends 4A, 4B in the tip ends. The open ends 4A, 4B correspond to the ends of the electrical conductive pattern 10, and are referred to as the open ends as described above in this specification so as to mean that the loop is open. The straight line pattern portions 4-2, 4-2 are extended along the reference line Rx from the base portions of the line pattern portions 4-1, 4-1 disposed in the vicinity of the reference line Rx so that the lines 4-1, 4-2 form the L shape. Moreover, the straight line pattern portions 4-3, 4-3 are extended from the straight line pattern portions 4-2, 4-2 substantially at right angles to the reference line Rx, apart from the reference line Rx, and in the opposite directions so that the line pattern portions 4-2, 4-3 form the L shape. Similarly, the straight line pattern portions 4-4, 4-4 are extended along the reference line Rx from the line pattern portions 4-3, 4-3 so that the lines 4-3, 4-4 form the L shape. In this manner, the line 4-j crossing at right angles to the reference line Rx is combined with the line 4-k extending along the reference line Rx in the L shape, and the pattern 4 bent along the reference line is extended. That is, the line pattern portions 4-1 to 4-3 are arranged so that, as shown in FIG. 2, the bend relating to the L-shaped combination proceeds along the reference line Rx. Moreover, on a closed-end side of the pattern 4, a pair of lines 4-n, 4-n crossing at right angles to or intersecting with the reference line Rx are substantially linearly connected to each other to cross the reference line Rx.

Here, the straight line pattern will be described as an example. It is also possible to replace the corner of the pattern with a curve. Moreover, the pattern by the curve is also possible.

Figure 3:
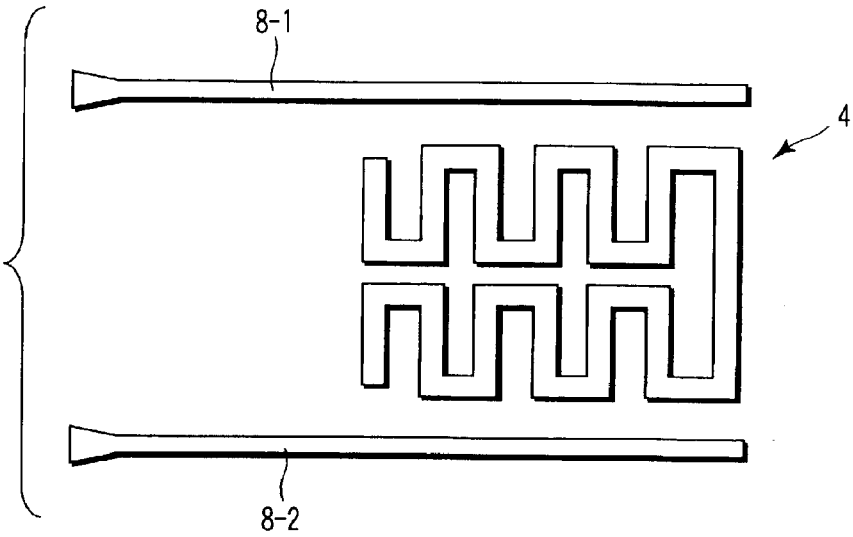
FIG. 3 is a plan view schematically showing a layout of the resonator in which an excitation line is disposed in the resonator pattern shown in FIG. 1.
Figure 4:
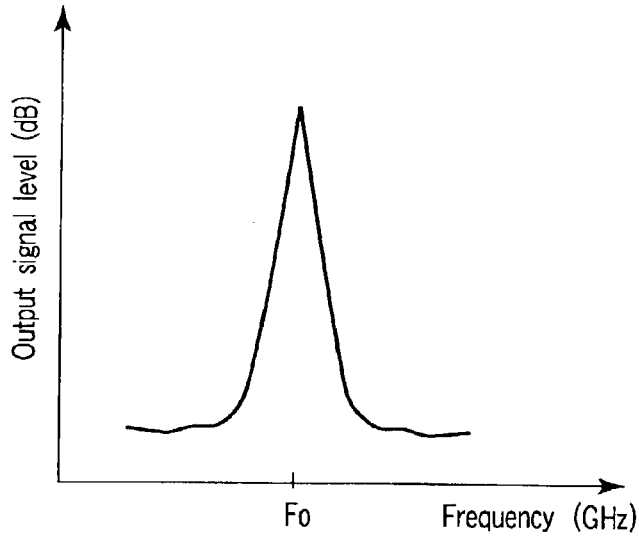
FIG. 4 is a graph showing a frequency characteristic of the resonator shown in FIG. 3.

As shown in FIG. 3, the excitation lines 8-1, 8-2 are extended along the reference line Rx in the upper surface of the substrate 2, and the pattern 4 of the resonator shown in FIG. 2 is disposed between the excitation lines 8-1, 8-2. The resonator shown in FIG. 3 has a pass characteristic of half-wavelength resonance as shown in FIG. 4. When an input signal is input from one of the excitation lines 8-1, 8-2, an output signal is output from the other line in accordance with the half-wavelength resonance pass characteristic shown in FIG. 4.

In a graph of the half-wavelength resonance pass characteristic shown in FIG. 4, a resonance frequency F0 is 1.93 GHz, resonance wavelength $\lambda$ is about 60 mm, and a steep half-wavelength resonance pass characteristic is indicated. It is to be noted that the resonance pattern shown in FIG. 2 has the following dimension as one example. That is, in FIG. 2, a distance x1 of the line pattern portion 4-1 between the first tip end 4A and the base end and a distance x2 of the line pattern portion 4-1 between the second tip end 4B and the base portion are set to x1=1.603 mm and x2=1.603 mm, respectively.

For the resonator pattern 4 shown in FIG. 2, when the half-wavelength resonance pass characteristic is adjusted, the resonator pattern 4 is irradiated with a laser beam, and a line portion having a predetermined length is cut/removed from the superconductor micro strip lines 4A, 4B. Either or both of the distance x1 of the line pattern portion 4-1 and the distance x2 of the line pattern portion 4-1 is adjusted by this cutting/removing, and the frequency characteristic of the resonator is adjusted. Therefore, there can be provided a resonator which is subjected to the adjustment of the line length and which has a desired half-wavelength resonance pass characteristic.

Figure 5:
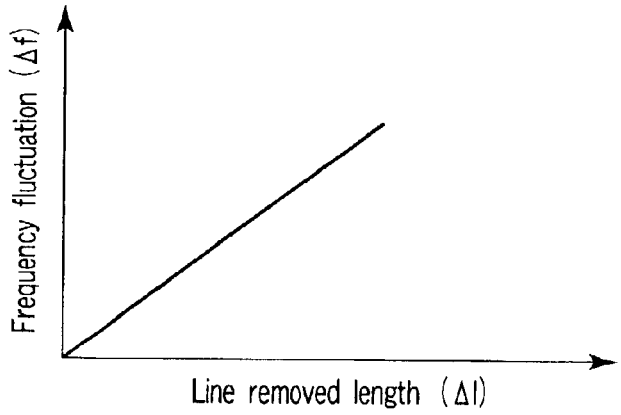
FIG. 5 is a graph showing a frequency fluctuation in changing a line length in the resonator including the resonator pattern shown in FIG. 1.

FIG. 5 shows a relation of a fluctuation Δf of the frequency to the length shaved with the laser beam, that is, a length Δl of a removed portion in the resonator shown in FIGS. 2 and 3. As apparent from FIG. 5, the fluctuation Δf of the frequency has a linear relation with respect to the length Δl of the removed line portion. When the line having the predetermined length is cut/removed, the resonator shown in FIG. 3 can easily be adjusted so as to have a planned frequency characteristic. That is, for the resonator having the pattern shown in FIG. 2, the frequency characteristic can be easily controlled.

It is to be noted that the graph of FIG. 5 is obtained by: preparing a resonator having the distance x1 of the line pattern portion 4-1 (x1=1.603 mm) and the distance x2 of the line pattern portion 4-1 (x2=1.603 mm); cutting/removing the tip ends 4A and 4B of the micro strip lines 4-1, 4-1 by a unit of 0.01 mm to measure the fluctuation Δf of the frequency of the resonator; and plotting the fluctuation Δf of the frequency in shaving a line length of 0.05 mm by the unit of 0.01 mm.

Comparative Example

Figure 6:
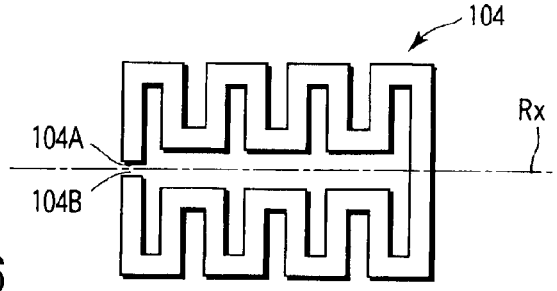
FIG. 6 is a plan view schematically showing a pattern of the resonator as a comparative example.
Figure 7:
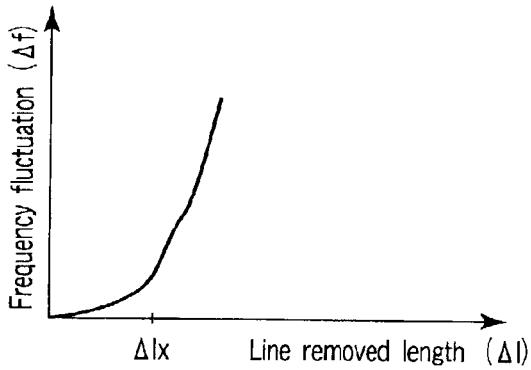
FIG. 7 is a graph showing the frequency fluctuation in changing the line length in the resonator including the resonator pattern of the comparative example shown in FIG. 6.

As a comparative example, the super-conductive micro strip line resonator having the pattern shown in FIG. 6 is prepared, and the relation of the fluctuation Δf of the frequency to the length Δl of the similarly removed portion is experimentally obtained as shown in FIG. 7.

A pattern 104 of the comparative example shown in FIG. 6 is formed in the open loop shape so that an electrical conductive pattern 110 has open ends 104A, 104B in the same manner as in the pattern 4 according to the embodiment of the present invention shown in FIG. 2. The line pattern portions are combined and extended so that the pattern is bent along the reference line Rx. For the pattern of the comparative example shown in FIG. 6, different from the pattern 4 shown in FIG. 2, the open ends 104A, 104B are disposed in the vicinity of each other, the line pattern portion on the open-end side is extended toward the reference line Rx from the base portion, and the tip ends of the portion are defined as the open ends 104A, 104B. That is, for the pattern 104 shown in FIG. 6, in line pattern portions 104-1, 104-1 having the open ends 104A, 104B, the base portion which is a base of bend is disposed in an outer region far from the reference line Rx, and the open ends 104A, 104B are disposed in the vicinity of the reference line Rx. On the other hand, as described above, for the pattern shown in FIG. 2 according to the embodiment of the present invention, in the line pattern portions 104-1, 104-1 having the open ends 104A, 104B, the base portion which is the base of bend is disposed in the vicinity of the reference line Rx, and the open ends 104A, 104B are disposed in the outer region apart from the reference line Rx.

The resonator having the pattern 104 of the comparative example shown in FIG. 6 also has the half-wavelength resonance pass characteristic similar to that shown in FIG. 4. For this half-wavelength resonance pass characteristic, in the same manner as in FIG. 4, the resonance frequency F0 is 1.93 GHz, the resonance wavelength λ is about 60 mm, and the steep half-wavelength resonance pass characteristic is indicated. It is to be noted that the resonator pattern shown in FIG. 6 has the dimension similar to that of FIG. 4. That is, in FIG. 6, the distance of the line pattern portion 104-1 between the first tip end 104A and the base end and the distance of the line pattern portion 104-1 between the second tip end 104B and the base portion are similarly set to 1.603 mm and 1.603 mm, respectively.

An experiment of fine adjustment of the length was carried out with respect to the resonator which has the pattern 104 of the comparative example shown in FIG. 6, and the relation of the fluctuation Δf of the frequency with respect to the length Δl of the removed portion was obtained as shown in FIG. 7. In this experiment, the tip end of the super-conductive micro strip line was similarly shaved down to 0.05 mm every 0.01 mm, and the characteristic was measured.

For the characteristic of the pattern 4 according to the embodiment of the present invention shown in FIG. 5, the fluctuation Δf of the frequency has the linear relation with respect to the shaved length Δl. However, in the resonator having the pattern 104 of the comparative example shown in FIG. 7, the relation between the shaved length Δl and the fluctuation Δf of the frequency is not linear as shown in FIG. 7. When a certain predetermined length Δlx is removed, the frequency is rapidly changed.

For the reason why the frequency fluctuation Δf is rapidly caused, the resonator having the pattern of the comparative example is disposed in the vicinity of and opposite to the tip ends 104A, 104B. Therefore, when the tip ends 104A, 104B are cut/removed, the capacitance between the tip ends 104A, 104B is rapidly changed from a certain removed length. On the other hand, the tip ends 4A, 4B are disposed sufficiently apart from each other in the resonator according to the embodiment of the present invention shown in FIGS. 2 and 4. Therefore, even when the tip ends 4A, 4B are shaved, the change of the capacitance between the tip ends 4A, 4B is small, and the capacitance does not largely fluctuate.

As described above, according to the resonator according to the embodiment of the present invention, when the length of the resonance element is finely adjusted, the characteristic does not largely fluctuate, and the filter characteristic can finely adjusted. This resonance element is provided.

Figure 8:
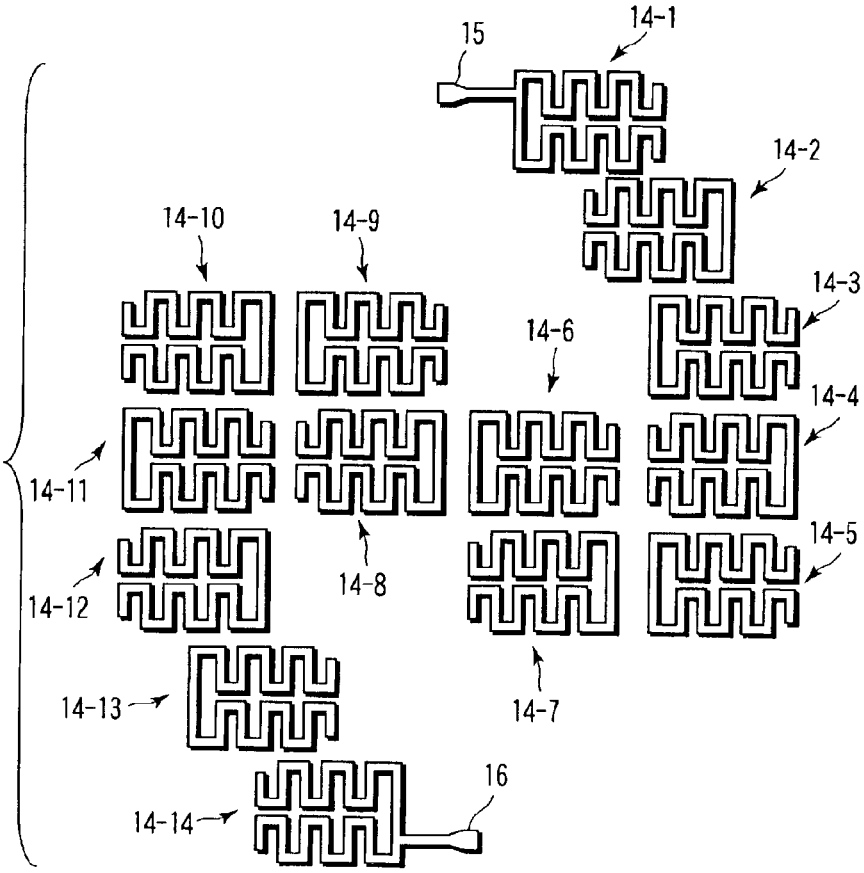
FIG. 8 is a plan view schematically showing a layout of a filter in which the resonator patterns shown in FIG. 2 are arranged in a plurality of poles.

FIG. 8 shows a layout of a pseudo-elliptic function type 14-pole filter which is constituted of resonator patterns 14-1 to 14-14 shown in FIG. 2. In this resonator, the resonator patterns 14-1 to 14-14 shown in FIG. 2 are disposed on one surface of the MgO substrate 2 in which a YBCO superconductive thin film is similarly formed on the other surface and whose film thickness is 0.43 mm and whose dielectric constant is about 10. The resonator shown in FIG. 8 has the half-wavelength resonance pass characteristic shown in FIG. 9.

Figure 9:
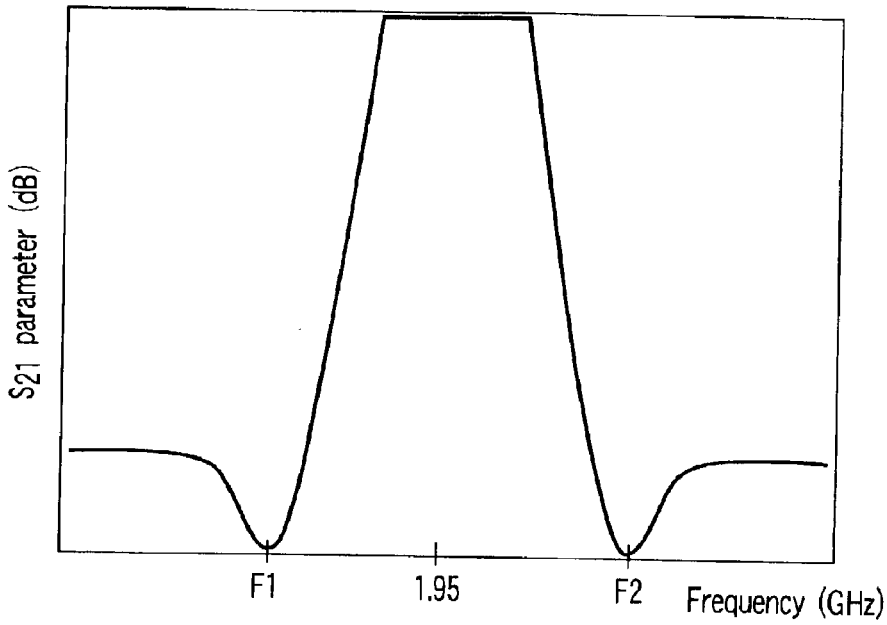
FIG. 9 is a graph showing the frequency characteristic of the filter shown in FIG. 8.

In the resonator shown in FIG. 8, the respective resonator patterns 14-1 to 14-14 are magnetically and capacitively (electrostatically) coupled to the adjacent resonator patterns 14-1 to 14-14. The input signal is input via an input end 15, and the output signal is output via an output end 16. The output signal related with the half-wavelength resonance pass characteristic shown in FIG. 9 is output via the output end 16 in accordance with the input signal. As shown in FIG. 9, attenuation poles F1, F2 are generated on opposite sides of a pass band, and a steep skirt characteristic is realized. It is clarified that this characteristic is obtained depending not only on the pattern shapes of the respective resonator patterns 14-1 to 14-14 but also on the arrangement of the resonator patterns 14-1 to 14-14.

(Second Embodiment)

Next, the resonator according to a second embodiment of the present invention will be described with reference to FIGS. 1 and 10.

Figure 10:
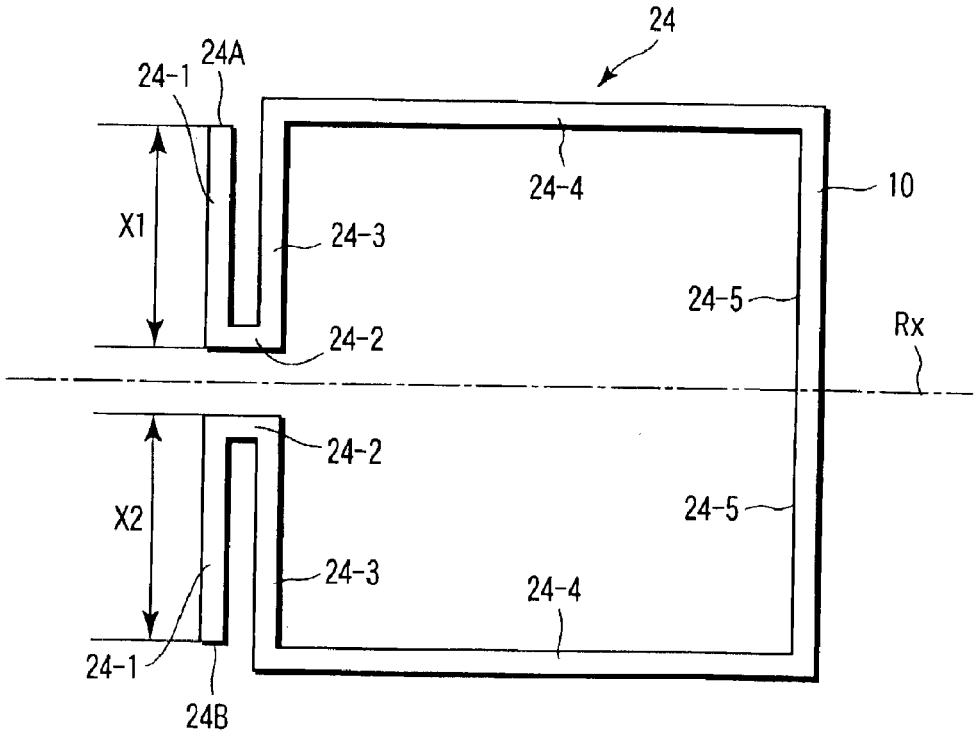
FIG. 10 is a plan view schematically showing the pattern of the resonator according to a second embodiment of the present invention.

FIG. 10 shows a pattern 24 of the super-conductive micro strip line resonator prepared on one surface of the MgO substrate 2 whose thickness is 0.43 mm and whose dielectric constant is about 10. In the same manner as in the first embodiment, the superconductor is formed of the YBCO thin film.

In the resonator pattern 24 shown in FIG. 10, the resonator pattern 24 is substantially symmetrical with respect to the certain reference line Rx as described above, and the electrical conductive pattern 10 is formed in a rectangular open loop shape so as to have open ends 24A, 24B. That is, straight line pattern portions 24-1 to 24-5 corresponding to the respective segments of the electrical conductive pattern 10 are subsequently symmetrically arranged with respect to the reference line Rx. These line pattern portions 24-1 to 24-5 are successively combined and arranged in the chain form so as to form the L shape. Here, the line pattern portions 24-1 and 24-2 are arranged in the same manner as in the pattern 4 shown in FIG. 2. On the other hand, the line pattern portions 24-3 to 24-5 form a rectangle centering on the reference line Rx which is a center line. On the closed side, the line pattern portion 24-5 crossing the reference line Rx is connected.

In the same manner as in FIG. 3, when the excitation lines 8-1, 8-2 are disposed in the resonator 24, the resonance frequency of the half-wavelength resonance is 1.95 GHz, and the resonance wavelength $\lambda$ is about 59 mm. For the resonator 24 having this characteristic, as shown in FIG. 10, the distances x1 and x2 of the lines 24-1, 24-2 are set to x1=3.0 mm and x2=3.0 mm.

In the same manner as described above, the experiment of the fine adjustment of the length of the resonator shown in FIG. 10 was carried out. The tip ends 24A, 24B of the super-conductive micro strip line were cut/removed by 0.14 mm every 0.02 mm. For the relation between the shaved length $\Delta l$ and the change $\Delta f$ of the resonance frequency, a relation similar to that shown in FIG. 5 was obtained. As described above, FIG. 5 reveals that the change $\Delta f$ of the resonance frequency has a linear relation with the removed length $\Delta l$ and the characteristic is easily controlled.

Figure 11:
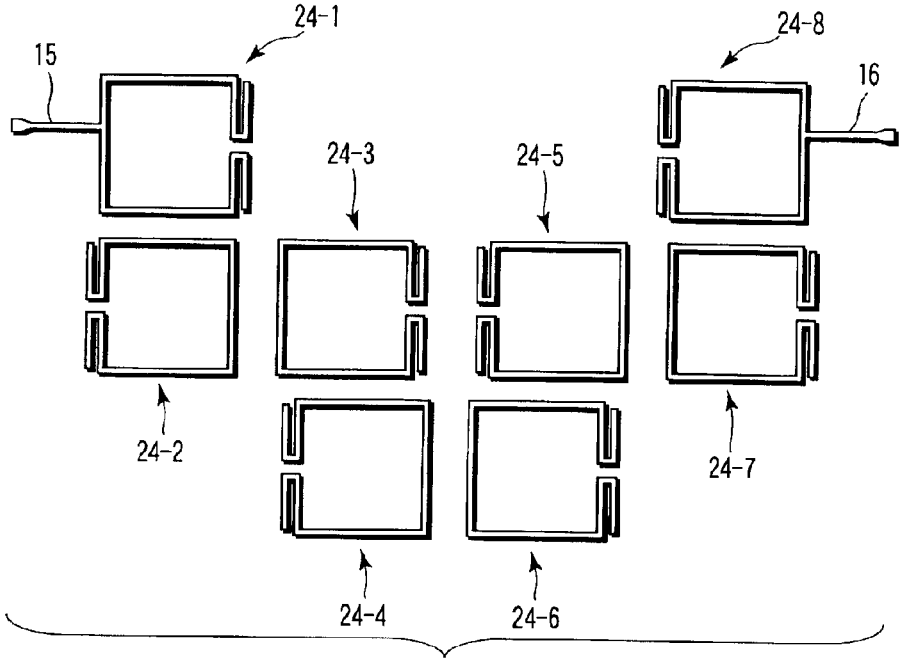
FIG. 11 is a plan view schematically showing the layout of the filter in which the resonator patterns shown in FIG. 10 are arranged in the plurality of poles.

FIG. 11 shows the layout of a pseudo-elliptic function type eight-pole filter in which the resonators shown in FIG. 10 are arranged in eight poles. In this filter, resonator patterns 24-1 to 24-8 shown in FIG. 9 are similarly arranged on one surface of the MgO substrate 2 on whose other surface the YBCO super-conductive thin film is formed and whose thickness is 0.43 mm and whose dielectric constant is about 10. The resonator shown in FIG. 10 has the half-wavelength resonance pass characteristic, which has a pattern similar to that shown in FIG. 4.

In the resonator shown in FIG. 11, the respective resonator patterns 24-1 to 24-8 are magnetically and capacitively (electrostatically) coupled to the adjacent resonator patterns 24-1 to 24-8. The input signal is input via the input end 15, and the output signal is output via the output end 16. The output signal related with the half-wavelength resonance pass characteristic shown in FIG. 11 is output via the output end 16 in accordance with the input signal. As shown in FIG. 9, the attenuation poles F1, F2 are generated on the both sides of a pass band, and the steep skirt characteristic is realized.

(Third Embodiment)

Figure 12:
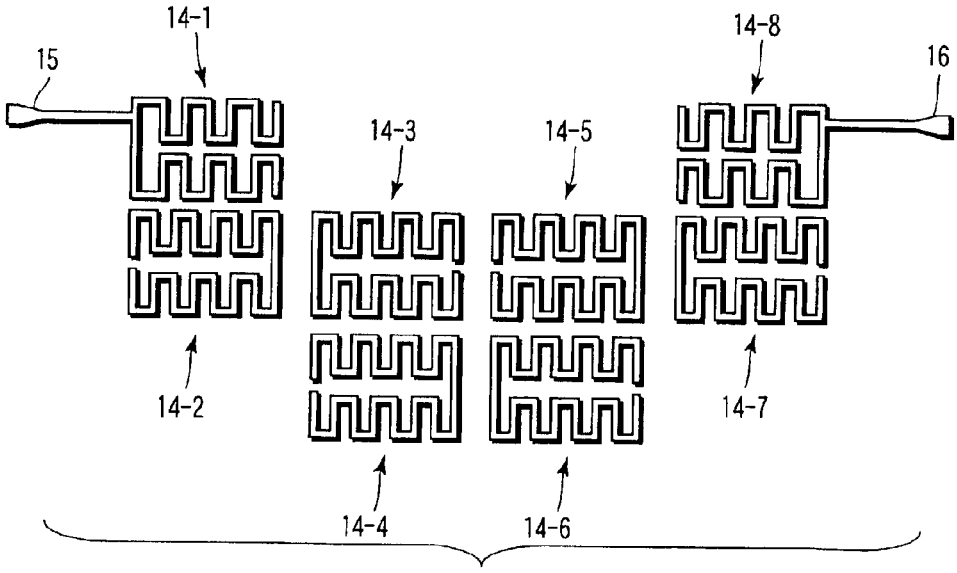
FIG. 12 is a plan view schematically showing the layout of the filter in which the resonator patterns shown in FIGS. 2 and 6 are arranged in the plurality of poles.

FIG. 12 shows the layout of the pseudo-elliptic function type 8-pole filter which is constituted of the resonator patterns 14-1 and 14-8 shown in FIG. 2 and the resonator patterns 14-2 to 14-7 shown as the comparative example in FIG. 6. In this filter, the resonator pattern shown in FIG. 2 is used only in the resonator patterns 14-1 and 14-8 of the first and eighth stages (last stage) connected to excitation lines 15, 16. Similarly, the resonator patterns 14-1, 14-8 shown in FIG. 2 and the resonator patterns 14-2 to 14-7 shown as the comparative example in FIG. 6 are arranged on one surface of the MgO substrate 2 on whose other surface the YBCO super-conductive thin film is formed and whose thickness is 0.43 mm and whose dielectric constant is about 10. The resonator shown in FIG. 12 has the half-wavelength resonance pass characteristic shown in FIG. 4.

The resonance frequencies of the resonator patterns 14-1, 14-8 connected to the excitation lines sometimes effectively shift to frequencies lower than those of the other resonator patterns 14-2 to 14-7 in accordance with the strength of excitation. Therefore, the resonators requiring frequency adjustment in a filter circuit are resonators in the first and last stages connected to the excitation lines 14-1, 14-8 in many cases. For this reason, in the present embodiment, the resonator patterns 14-1, 14-8 shown in FIG. 2, that is, the resonator patterns in which the frequencies are easily adjusted are employed only in the first and last stages.

Also in the resonator shown in FIG. 12, the respective resonator patterns 14-1 to 14-8 are magnetically and capacitively (electrostatically) coupled to the adjacent resonator patterns 14-1 to 14-8. The input signal is input via the input end 15, and the output signal is output via the output end 16. The output signal related with the half-wavelength resonance pass characteristic shown in FIG. 9 is output via the output end 16 in accordance with the input signal. As shown in FIG. 9, the attenuation poles F1, F2 are generated on the both sides of a pass band, and the steep skirt characteristic is realized.

(Fourth Embodiment)

Figure 13:
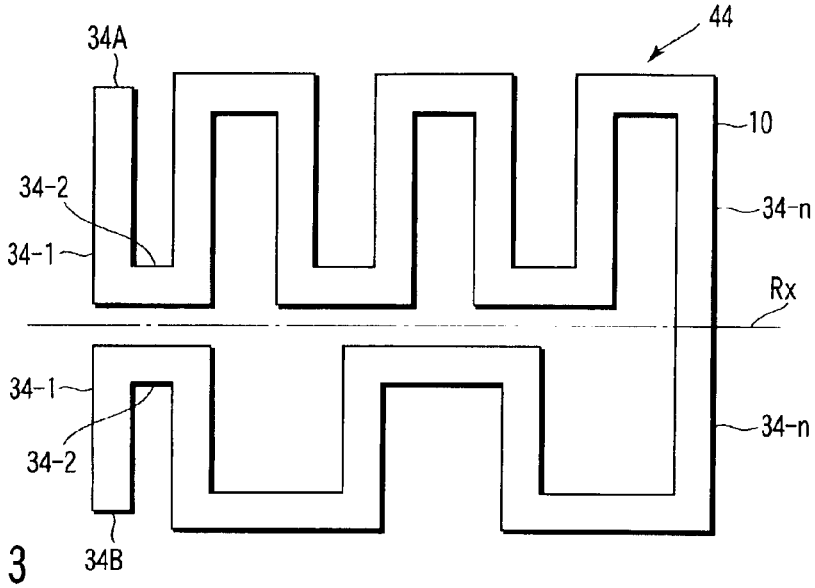
FIG. 13 is a plan view schematically showing the pattern of the resonator according to a third embodiment of the present invention.

In the above-described first to third embodiments, the resonator patterns are formed symmetrically with respect to the reference line Rx, but the resonator patterns may not necessarily be formed symmetrically with respect to the reference line Rx. As shown in FIG. 13, a resonator pattern 34 is formed asymmetrically with respect to the certain reference line Rx. Here, the electrical conductive pattern 10 is formed in the open loop shape so as to have open ends 34A, 34B, and these are bent and extended along the reference line Rx. That is, straight line pattern portions 34-1 to 34-n corresponding to the respective segments of the electrical conductive pattern 10 form pairs with counterparts, and the portions of each pair are arranged on the opposite sides of the reference line Rx. On each side, these line pattern portions 34-1 to 34-n are successively combined, connected, and arranged in the chain form to form the L shapes. Here, the line pattern portions 34-1 to 34-n of the respective pairs are asymmetrical with respect to the reference line Rx, and therefore have different pattern lengths. For example, the line patterns 34-1, 34-1 are disposed opposite to each other on the opposite sides of the reference line Rx, but have different pattern lengths, and are therefore asymmetrical.

In the resonator pattern 34 shown in FIG. 13, on the open-end side of the open loop shape, the line pattern portions 34-1, 34-1 are extended substantially at right angles to the reference line Rx, apart from the reference line Rx, and in the opposite directions so as to have the open ends 34A, 34B in the tip ends. The straight line pattern portions 34-2, 34-2 are extended along the reference line Rx from the base portions of the line pattern portions 34-1, 34-1 disposed in the vicinity of the reference line Rx so that the lines 34-1, 34-1 form a L shape. Similarly, the pattern 34 is formed in which the line pattern portions are extended and bent along the reference line Rx to form a L shape. That is, the line pattern portions are arranged so that the bend relating to the L-shaped combination proceeds along the reference line Rx as shown in FIG. 13. Moreover, on the closed-end side of the pattern 34, a pair of lines 34-n, 34-n crossing at right angles to or intersecting with the reference line Rx are substantially linearly connected to each other and cross the reference line Rx.

For the resonator pattern 34 shown in FIG. 13, when the half-wavelength resonance pass characteristic is adjusted as described above, the resonator pattern 34 is irradiated with the laser beam and the line portion having the predetermined length is cut/removed from the super-conductive micro strip lines 34A, 34B. That is, as described above, the removed length $\Delta l$ has a linear relation with the fluctuation $\Delta f$ of the frequency in the resonator pattern 34 shown in FIG. 13. When the line length is appropriately adjusted, a resonator having the desired half-wavelength resonance pass characteristic can be provided.

Figure 14:
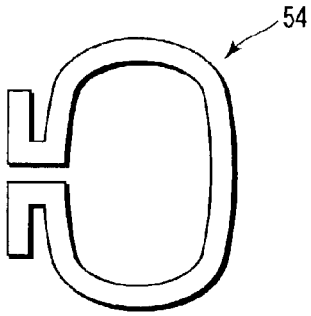
FIG. 14 is a plan view schematically showing a pattern example of the resonator according to another embodiment of the present invention.

In the resonator pattern 34 shown in FIG. 13, the straight line pattern portions corresponding to the respective segments of the electrical conductive pattern 10 are successively combined in the chain form to form the L shapes. However, each segment does not necessarily have to be straight, and curved segments may also be used so as to have a desired resonance characteristic. For example, as shown in FIG. 14, the open loop shaped portion of a resonator pattern 54 is elliptical, and it is also possible to dispose the open end from the opening.

Figure 15:
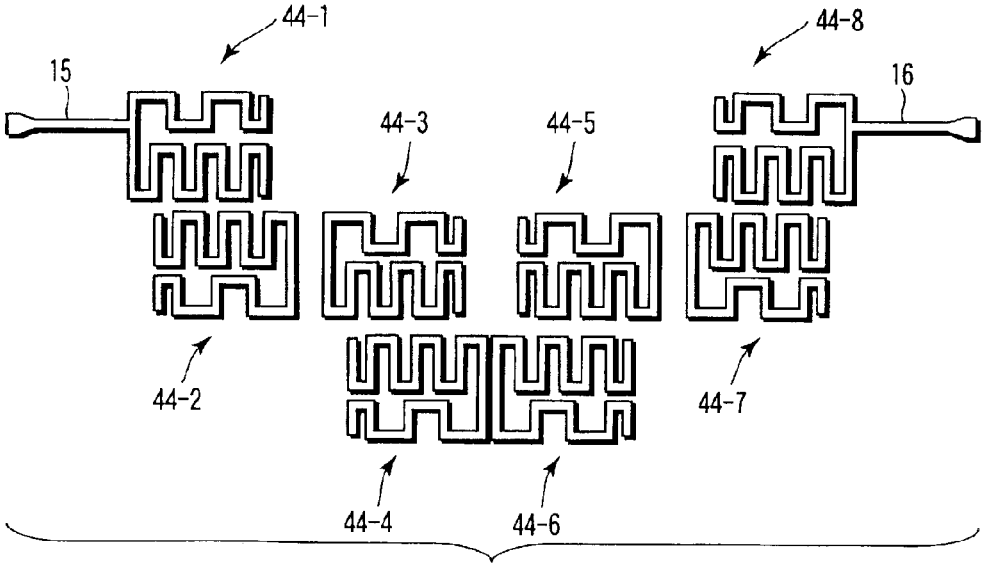
FIG. 15 is a plan view schematically showing the layout of the filter in which the resonator patterns shown in FIG. 13 are arranged in the plurality of poles.

FIG. 15 shows the layout of the pseudo-elliptic function type eight-pole filter constituted of resonator patterns 44-1 to 44-8 shown in FIG. 13. The resonator patterns 44-1 to 44-8 shown in FIG. 15 are similarly disposed on one surface of the MgO substrate 2 on whose other surface the YBCO super-conductive thin film is formed and whose thickness is 0.43 mm and whose dielectric constant is about 10. The resonator shown in FIG. 15 has the half-wavelength resonance pass characteristic shown in FIG. 9.

In the resonator shown in FIG. 15, the respective resonator patterns 44-1 to 44-8 are magnetically and capacitively (electrostatically) coupled to the adjacent resonator patterns 44-1 to 44-8. The input signal is input via the input end 15, and the output signal is output via the output end 16. The output signal related with the half-wavelength resonance pass characteristic shown in FIG. 9 is output via the output end 16 in accordance with the input signal. As shown in FIG. 9, the attenuating poles F1, F2 are generated on the opposite sides of the pass band, and a steep skirt characteristic is realized. Here, the attenuation poles F1, F2 are generated on the both sides of the pass band. It is clarified that this characteristic is obtained depending not only on the pattern shapes of the respective resonator patterns 44-1 to 44-8 but also on the arrangement of the resonator patterns 44-1 to 44-8.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A resonator comprising:

a substrate having a surface on which an imaginary reference line is defined; and a strip conductive line shaped in an open loop on the substrate, which has opening end sections faced to each other with an opening gap on the imaginary reference line, and straight line sections continuously extended from the opening end sections in opposite directions substantially normal to the imaginary reference line and having tip ends arranged at both sides of the reference line, respectively, the straight line sections and the opening end sections being substantially formed in a L-shape.

2. The resonator according to claim 1, wherein the strip line has a shape symmetrical with respect to the imaginary reference line.

3. The resonator according to claim 1, wherein the strip line includes chains of L-shaped pattern portions.

4. The resonator according to claim 1, wherein the strip line is formed of super-conductor.

5. A filter comprising a resonator, the resonator including:

a substrate having a surface on which an imaginary reference line is defined;

a strip conductive line shaped in an open loop on the substrate, which has opening end sections faced to each other with an opening gap on the imaginary reference line, and straight line sections continuously extended from the opening end sections in opposite directions substantially normal to the imaginary reference line and having tip ends arranged at both sides of the reference line, respectively, the straight line sections and the opening end sections being substantially formed in a L-shape.

6. The filter according to claim 5, wherein the strip line of the resonator has a shape symmetrical with respect to the reference line.

7. The filter according to claim 5, wherein the strip line of the resonator includes chains of L-shaped pattern portions.

8. The filter according to claim 5, wherein the strip line is formed of super-conductor.

9. The filter according to claim 5, wherein the strip line of the resonator has a shape symmetrical with respect to the reference line.

10. A filter comprising:

a substrate having a surface on which an imaginary reference line is defined;

a first resonator including a strip conductive line shaped in an open loop on the substrate, which has opening end sections faced to each other with an opening gap on the imaginary reference line, and straight line sections continuously extended from the opening end sections in opposite directions substantially normal to the imaginary reference line and having tip en s arranged at both sides of the reference line, respectively, the straight line sections and the opening end sections being substantially formed in a L-shape; and a second resonator electrically coupled to the first resonator, the second resonator including a strip conductive line shaped in an open loop on the substrate, which has opening end sections faced to each other with an opening gap on the imaginary reference line, and straight line sections continuously extended from the opening end sections in opposite directions substantially normal to the imaginary reference line and having tip ends arranged at both sides of the reference line, respectively, the straight line sections and the opening end sections being substantially formed in a L-shape.

* * * * *

UNITED STATES PATENT AND TRADEMARK OFFICE

CERTIFICATE OF CORRECTION

PATENT NO. : 6,897,745 B2
DATED : May 24, 2005
INVENTOR(S) : Aiga et al.

It is certified that error appears in the above-identified patent and that said Letters Patent is hereby corrected as shown below:

Column 10,
Line 66, change “tip en s” to -- tip ends --.

Signed and Sealed this

Ninth Day of August, 2005

JON W. DUDAS
*Director of the United States Patent and Trademark Office*